United States Patent [19]

Hagel et al.

[11] 4,049,432

[45] Sept. 20, 1977

[54] HIGH STRENGTH FERRITIC ALLOY-D53

[75] Inventors: William C. Hagel, Ann Arbor, Mich.; Frederick A. Smidt, Springfield, Va.; Michael K. Korenko, Richland, Wash.

[73] Assignee: The United States of America as represented by the United States Energy Research and Development Administration, Washington, D.C.

[21] Appl. No.: 728,362

[22] Filed: Sept. 30, 1976

[51] Int. Cl.[2] ..... C22C 38/44; C22C 38/46; C22C 38/54

[52] U.S. Cl. ..... 75/128 F; 75/128 V; 75/128 W; 148/36

[58] Field of Search ..... 148/36, 37; 75/128 F, 75/128 V, 128 W, 126 P, 126 C, 126 B, 126 F

[56] References Cited

U.S. PATENT DOCUMENTS 2,572,191 10/1951 Payson ..... 148/36

OTHER PUBLICATIONS

Trans ASM, vol. 37, 1946, p. 365.

*Primary Examiner*—Arthur J. Steiner
*Attorney, Agent, or Firm*—Dean E. Carlson; Richard E. Constant; Ignacio Resendez

[57] ABSTRACT

A high strength ferritic alloy is described having from about 0.2% to about 0.8% by weight nickel, from about 2.5% to about 3.6% by weight chromium, from about 2.5% to about 3.5% by weight molybdenum, from about 0.1% to about 0.5% by weight vanadium, from about 0.1% to about 0.5% by weight silicon, from about 0.1% to about 0.6% by weight manganese, from about 0.12% to about 0.20% by weight carbon, from about 0.02% to about 0.1% by weight boron, a maximum of about 0.05% by weight nitrogen, a maximum of about 0.02% by weight phosphorous, a maximum of about 0.02% by weight sulfur, and the balance iron.

3 Claims, 2 Drawing Figures

HIGH STRENGTH FERRITIC ALLOY-D53

BACKGROUND OF INVENTION

The invention relates to a novel, high strength ferritic alloy designated alloy D53.

The alloy Fe-2.25Cr-1.0Mo (ASTM A 387-D) has widepsread commercial applications; however, the use of this material is limited in many applications because of its moderate strength levels.

In strengthening the ferritic class of materials, most of the emphasis has been directed historically to the 12 weight percent range of chromium content. The use of high levels of chromium results in an increase in the overall cost of the material and an increased dependence on critical raw materials.

The alloy of this invention was designed to limit the use of chromium by incorporating the strengthening effects of boron while avoiding compositions which would lead to the precipitation of any detrimental phases. The resultant alloy is relatively economical and has good commercial potential and exhibits high strength characteristics.

SUMMARY OF INVENTION

In view of the above, it is an object of this invention to provide a novel ferritic alloy having high strength properties.

It is a further object of this invention to provide a novel ferritic alloy having superior strength to the commercial alloy Fe-2.25Cr-1.0Mo.

It is a further object of this invention to provide a high strength ferritic alloy useful for steam turbine and steam generator tubing applications.

Various other objects and advantages will appear from the following description of the invention and the most novel features will be pointed out hereinafter in connection with the appended claims. It will be understood that various changes in the detail and composition of the alloy components which are herein described in order to explain the nature of the invention may be made by those skilled in the art without departing from the principles and scope of this invention.

The invention comprises a ferritic alloy, which alloy is useful for steam turbine tubing applications, and which alloy contains from about 0.2% to about 0.8% by weight nickel, from about 2.5% to about 3.6% by weight chromium, from about 2.5% to about 3.5% by weight molybdenum, from about 0.1% to about 0.5% by weight vanadium, from about 0.1% to about 0.5% by weight silicon, from about 0.1% to about 0.6% by weight manganese, from about 0.12% to about 0.20% by weight carbon, from about 0.02% to about 0.1% by weight boron, a maximum of about 0.05% by weight nitrogen, a maximum of about 0.02% by weight phosphorous, a maximum of about 0.02% by weight sulfur, and the balance iron.

DETAILED DESCRIPTION

Figure 1:
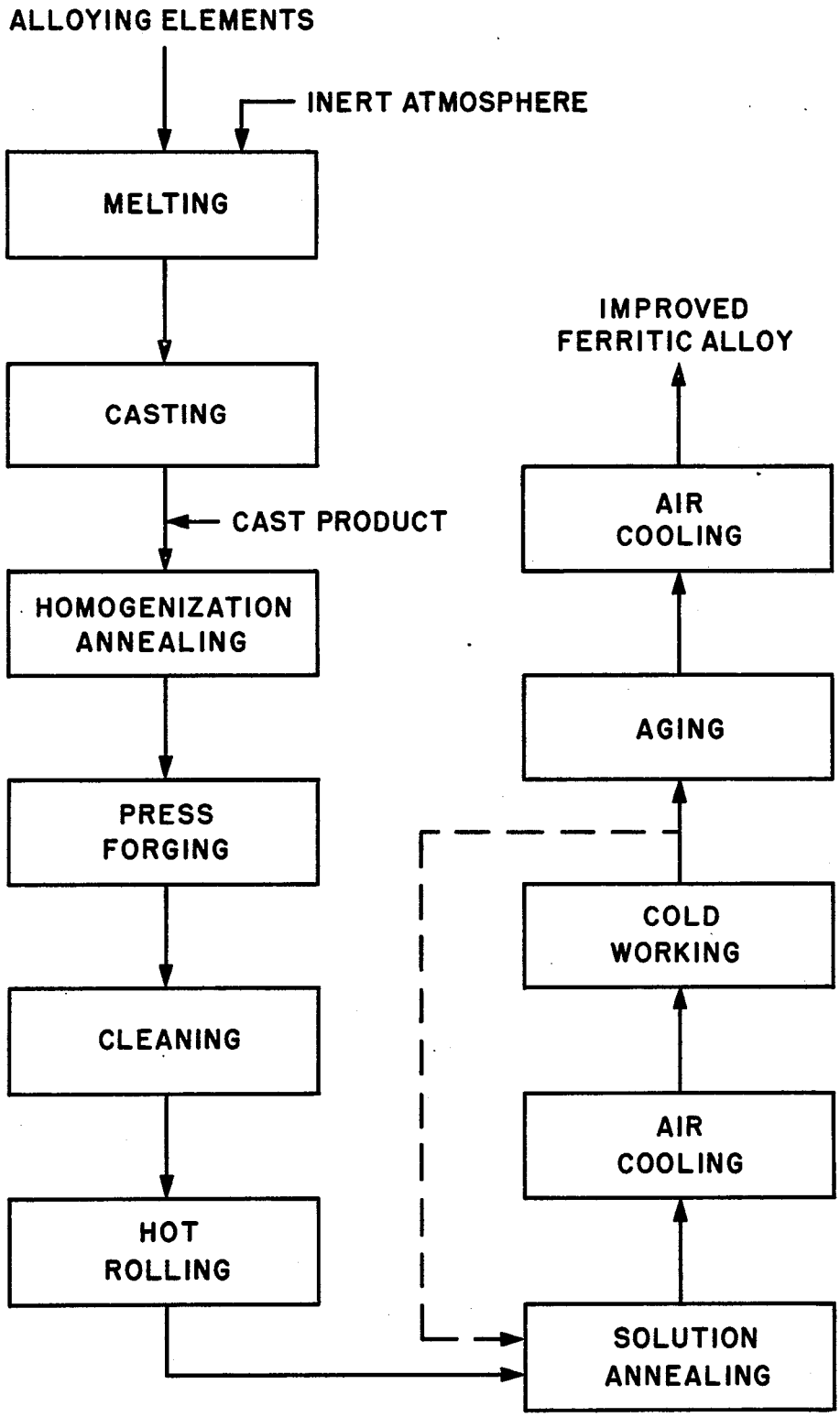
FIG. 1 outlines a flow process for obtaining the ferritic alloy of this invention.

The alloy of this invention may be prepared using the flow sequence illustrated in the drawing. The alloying elements may be added to provide an alloy composition having a general range of from about 0.2% to about 0.8% by weight nickel, from about 2.5% to about 3.6% by weight chromium, from about 2.5% to about 3.5% by weight molybdenum, from about 0.1% to about 0.5% by weight vanadium, from about 0.1% to about 0.5% by weight silicon, from about 0.1% to about 0.6% by weight manganese, from about 0.12% to about 0.20% by weight carbon, from about 0.02% to about 0.1% by weight boron, a maximum of about 0.05% by weight nitrogen, a maximum of about 0.02% by weight phosphorous, a maximum of about 0.02% and 0.05% by weight has been given for sulfur and phosphorous and nitrogen respectively, the concentration of these elements is preferably maintained as low as possible, and it is desirable not to have these present in the alloy composition.

The alloying elements may be fed into a suitable furnace, such as an induction furnace, and may be melted in air while protecting the surface of the melt by a layer or argon or other inert gas. In the alternative, it may be desirable to melt the alloy composition in an inert atmosphere to protect against nitrogen absorption as known in the art. The alloying elements may be added as ferrous alloys except that it may be desirable to use pure additions of carbon, aluminum, and electrolytic iron. Aluminum is added as a deoxidant, but does not form a part of the final product.

After melting, the melt or heat was poured into a suitable ingot form such as cylindrical ingots having dimensions of 90 millimeters (mm) diameter 320 mm length. The casting was then subjected to a 2-hour soak or solution annealing at a temperature range of from about 1125° C to about 1225° C, and generally at about 178 1175° C. The solution annealed cast ingot was then press forged at a suitable temperature range such as between about 1125° C and about 1225° C and generally at about 1175° C, into a sheet bar of suitable dimensions such as 25 mm thick by 150 mm wide by 685 mm long. For test purposes, the sheet bar was then grit blasted or otherwise cleaned to remove surface oxidation and thereafter sectioned into 150 mm lengths for hot rolling. This hot rolling involved initially broad rolling to a 205 mm width followed by straight rolling to a 2 mm thickness. Thirteen mm wide strips were then removed and solution annealed at from about 1100° C to about 1200° C, and generally at about 1150° C, for from about 0.5 to 2 hours, or such as at about 178 hour in a protective hydrogen atmosphere before air cooling. The hydrogen atmosphere was provided in order to provide oxidation resistance.

The solution annealed strips were then air cooled and subsequently cold worked to a 20% reduction from the 2 mm thickness to a 1.5 mm thickness. This reduction was accomplished by repeatedly cycling the material through the solution annealing, air cooling, and cold working steps, indicated in the drawing by the dotted line, until attaining the desired thickness. After the final cold working, the strips were subjected to an aging treatment at a temperature of from about 700° C to about 760° C, and generally at about 730° C, for from about 0.5 to about 2 hours. After the aging treatment, the strips were air cooled to ambient temperature.

Table I illustrates the chemical compositions for four alloys which were made and produced by the above described process including the cold working, forging, aging, etc., treatments. For convenience and case of description, the alloys are arbitrarily herein referred to as alloys D51, D53, D54 and D55.

While the general range of this alloy has been presented above, a preferred range is from about 0.2% to about 0.7% by weight nickel, from about 2.8% to about 3.3% by weight chromium, from about 2.6% to about 3.5% by weight molybdenum, from about 0.1% to about 0.3% by weight vanadium, from about 0.2% to about 0.4% by weight silicon, from about 0.2% to about 0.6% by weight manganese, from about 0.13% to about 0.20% by weight carbon, from about 0.03% to about 0.05% by weight boron, and the remainder iron. More specifically, a preferred composition may be about 0.6% by weight nickel, about 3.1% by weight chromium, about 3.0% by weight molybdenum, about 0.25% by weight vanadium, about 0.3% by weight silicon, about 0.4% by weight manganese, about 0.16% by weight carbon, about 0.35% by weight boron, and the remainder iron. These preferred ranges assure that there are optimum amounts of boride and carbide strengthening phases.

The alloy of this invention, illustrated by the composition alloy D53 in Table I, used the addition of boron in the ranges presented herein, together with the other constituents of the alloy, to yield a strengthened ferritic alloy which has superior mechanical properties to the comparable commercial alloys. X-ray analysis of the extracted phases revealed that the $M_3B_2$ phase is the prime ferritic alloy strengthener. Solution treating at 950° to 1050° C for 0.5 hours with an air cool followed by aging at 675° to 725° C for 1 hour with an air cool was found to be very effective in optimizing the precipitation of the strengthening phase.

The room temperature tensile properties of the candidate ferritic alloys are presented in Table II. Alloy D53 is the strongest material of these alloys and yet still exhibits an acceptably high level of ductility. The primary difference between alloy D53 and alloys D54 and D55 is the boron addition in the former, thus illustrating the strengthening potential of the boron addition to this 3Mo-3Cr class of alloy.

The long term phase stability of these materials was tested by aging at 474° C for 500 hours followed by tensile testing. Materials of this class frequently display embrittlement at this temperature. As Table III illustrates, alloy D53 maintained its strength and ductility levels even after long time exposures at temperature. This demonstrates that there is an absence of detrimental phases which might degrade the mechanical properties of this alloy during service.

The high temperature tensile properties of these alloys are presented in Table IV. The 0.2% offset yield strength and the ultimate tensile strength of alloy D53 is superior at all temperatures. The fact that this difference is more pronounced at these higher temperatures than at room temperature is significant since the most promising applications for this material are in high temperature service as steam turbine and generator tubing.

Table V further verifies the high temperature strength potential of alloy D53. Over the whole temperature range from 510° to 705° C this material is substantially harder than the other candidates. Thus, the unique combination of Cr, Mo, V, C and B of alloy D53 leads to an improved strength level.

Figure 2:
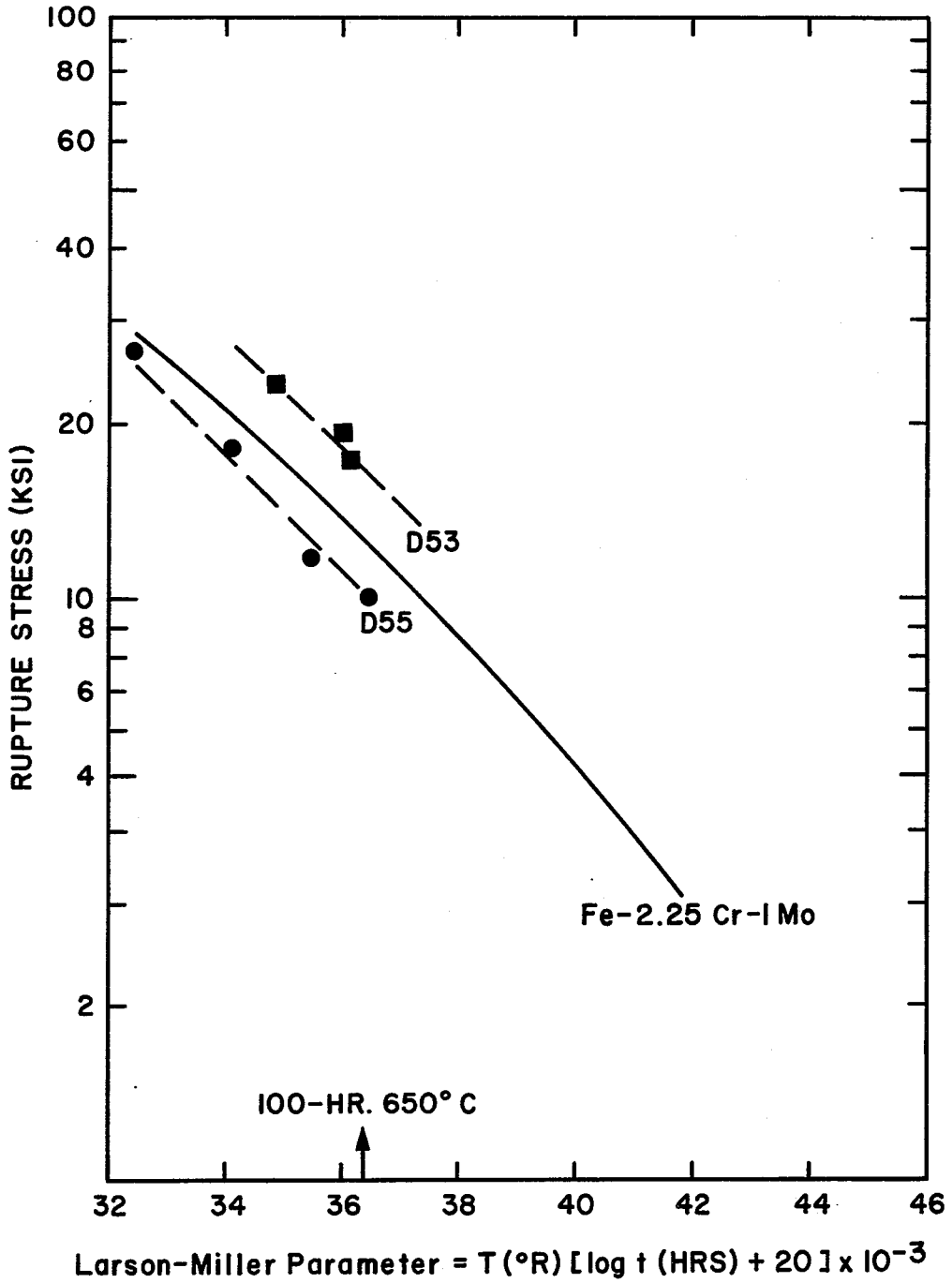
FIG. 2 compares the stress rupture properties of this alloy with that of Fe-2.25Cr-1Mo.

Finally, the 650° C stress rupture data presented in Table VI illustrate the superiority of alloy D53 over that of alloy D55. The comparable 650° C, 100 hours stress rupture value of Fe-2.25Cr-1Mo. is approximately 14 ± 1 thousand pounds per square inch (ksi), thus illustrating the superiority of this alloy over its commercial counterpart. A 20% increase in stress rupture strength of alloy D53 over Fe-2.25Cr-1Mo is equivalent to a much larger increase in rupture time at a given stress. FIG. 2 illustrates these differences on the standard engineering plot of stress to rupture versus Larson Miller Parameter.

This invention provides a novel alloy composition that is of superior strength to other ferritic materials, and is especially adaptable for steam generator tubing applications.

TABLE I

| | ELEMENT, % BY WEIGHT, BALANCE IRON | | | | | | | | | | | |
|---|---|---|---|---|---|---|---|---|---|---|---|---|
| Alloy | C | Mn | Si | Cr | Ni | Mo | Nb | V | N | P | S | Other |
| D51 | 0.06 | 4.2 | 1.36 | 17.68 | — | 1.06 | — | 0.19 | 0.065 | 0.016 | 0.0025 | — |
| D53 | 0.16 | 0.44 | 0.32 | 3.16 | 0.59 | 3.02 | — | 0.23 | 0.023 | 0.005 | 0.005 | 0.035B |
| D54 | 0.03 | 0.50 | 0.17 | 3.17 | 3.26 | 3.03 | 0.097 | — | 0.018 | 0.005 | 0.003 | — |
| D55 | 0.14 | 0.51 | 0.12 | 3.11 | 3.27 | 2.98 | 0.097 | — | 0.022 | 0.006 | 0.004 | — |

TABLE II

| ROOM TEMPERATURE TENSILE PROPERTIES | | | | |
|---|---|---|---|---|
| Alloy | 0.2% Offset Yield Strength (ksi) | Tensile Strength (ksi) | Elongation (%) | Reduction in Area (%) |
| D51 | 95.2 | 110.7 | 11.7 | 34.4 |
| | 87.1 | 103.4 | 11.5 | 31.0 |
| D53 | 101.2 | 119.9 | 10.0 | 44.4 |
| | 105.6 | 124.8 | 9.7 | 29.9 |
| D54 | 83.9 | 96.5 | 16.2 | 47.2 |
| | 82.5 | 95.9 | 16.0 | 49.8 |
| D55 | 100.7 | 120.8 | 11.7 | 38.6 |
| | 99.2 | 120.9 | 11.5 | 42.1 |

TABLE III

| ROOM TEMPERATURE TENSILE PROPERTIES FOLLOWING EXPOSURE AT 474° C FOR 500 HOURS | | | | |
|---|---|---|---|---|
| Alloy | 0.2% Offset Yield Strength (ksi) | Tensile Strength (ksi) | Elongation (%) | Reduction in Area (%) |
| D51 | 109.8 | 122.9 | 9.5 | 16.0 |
| | 104.9 | 119.5 | 13.0 | 27.5 |
| D53 | 97.1 | 116.0 | 8.5 | 45.0 |
| | 100.7 | 117.5 | 8.0 | 43.5 |
| D54 | 90.9 | 97.8 | 15.0 | 53.0 |
| | 91.3 | 98.7 | 15.5 | 56.0 |
| D55 | 102.6 | 109.9 | 11.5 | 33.5 |
| | 102.8 | 110.9 | 10.5 | 34.0 |

TABLE IV

| HIGH TEMPERATURE TENSILE PROPERTIES | | | | | |
|---|---|---|---|---|---|
| | Alloy | 0.2% Offset Yield Strength (ksi) | Tensile Strength (ksi) | Elongation (%) | Reduction in Area (%) |
| 550° C: | D51 | 51.9 | 56.6 | 18.5 | 51.0 |
| | D53 | 69.6 | 79.4 | 11.5 | 49.0 |
| | D54 | 55.0 | 61.7 | 14.5 | 50.5 |
| | D55 | 52.5 | 62.6 | 12.0 | 46.5 |
| 600° C: | D51 | 38.1 | 41.2 | 23.5 | 66.0 |
| | D53 | 54.0 | 65.5 | 15.0 | 32.5 |
| | D54 | 43.4 | 51.2 | 18.5 | 57.0 |
| | D55 | 41.7 | 49.5 | 22.0 | 55.5 |
| 650° C: | D51 | 24.5 | 27.9 | 30.5 | 82.5 |
| | D53 | 35.4 | 48.5 | 21.0 | 64.5 |
| | D54 | 23.2 | 32.8 | 30.5 | 70.0 |

TABLE IV-continued

| HIGH TEMPERATURE TENSILE PROPERTIES | | | | |
|---|---|---|---|---|
| Alloy | 0.2% Offset Yield Strength (ksi) | Tensile Strength (ksi) | Elongation (%) | Reduction in Area (%) |
| D55 | 28.4 | 35.6 | 30.5 | 66.5 |

All alloys were treated according to Table II.

TABLE V

| HOT HARDNESS (HV 10)[a] AT INDICATED TEMPERATURE (° C) | | | | | | | | |
|---|---|---|---|---|---|---|---|---|
| Alloy | 510 | 540 | 565 | 595 | 620 | 650 | 675 | 705 |
| D51 | 160 | 140 | 115 | 98 | 84 | 76 | 62 | 53 |
| D53 | 202 | 187 | 170 | 152 | 130 | 112 | 83 | 73 |
| D54 | 166 | 154 | 137 | 118 | 102 | 84 | 64 | 50 |
| D55 | 174 | 159 | — | 121 | 101 | 86 | 72 | 61 |

[a]HV 10 = Vickers Hardness Test, 10 kilogram load

TABLE VI

| CREEP AND STRESS RUPTURE PROPERTIES AT 650° C | | | | | | |
|---|---|---|---|---|---|---|
| Alloy | Applied Stress (ksi) | Minimum Creep Rate (%/Hr) | Time to Rupture (Hrs) | Elongation (%) | Reduction in Area (%) | 100 Hour Rupture Strength (ksi) |
| D53 | 17 | 1.6 | 54.3 | 33.0 | 42.5 | |
| | 19 | 0.33 | 48.3 | 39.0 | 44.0 | |
| | 20 | —[a] | 56.7 | — | — | |
| | 23 | 0.30 | 10.1 | 36.0 | 46.5 | |
| | 25 | — | 16.3 | — | — | 17.0 ± 1 |
| | 38 | — | 0.5 | — | — | |
| | 42 | — | 0.033 | — | — | |
| | 53 | — | 0.016 | — | — | |
| D55 | 10 | 0.25 | 86.2 | 34.0 | 30.0 | |
| | 12.5 | — | 116.1 | — | — | |
| | 13.5 | 0.75 | 24 | 34.0 | 28.0 | |
| | 15 | — | 34 | — | — | |
| | 18 | 5.5 | 3.5 | 33.5 | 47.0 | 11.0 ± 1 |
| | 23 | — | 2.4 | — | — | |
| | 27.3 | 17.0 | 0.3 | 39.5 | 63.5 | |
| | 32 | — | 0.16 | — | — | |
| | 42 | — | 0.033 | — | — | |

[a]Blank spaces indicate property not measured.

What we claim is:

1. A high strength ferritic alloy consisting of from about 0.2% to about 0.8% by weight nickel, from about 2.5% to about 3.6% by weight chromium, from about 2.5% to about 3.5% by weight molybdenum, from 0.1% to about 0.5% by weight vanadium, from about 0.1% to about 0.5% by weight silicon, from about 0.1% to about 0.6% by weight manganese, from about 0.12% to about 0.20% by weight carbon, from about 0.02% to about 0.1% by weight boron, a maximum of about 0.05% by weight nitrogen, a maximum of about 0.02% by weight sulfur, a maximum of about 0.02% by weight phosphorous, and the balance iron.

2. The alloy of claim 1 consisting of from about 0.2% to about 0.7% by weight nickel, from about 2.8% to about 3.3% by weight chromium, from about 2.6% to about 3.5% by weight molybdenum, from about 0.01% to about 0.3% by weight vanadium, from about 0.2% to about 0.4% by weight silicon, from about 0.2% to about 0.6% by weight manganese, from about 0.13% to about 0.20% by weight carbon, from about 0.03% to about 0.05% by weight boron, and the balance iron.

3. The alloy of claim 1 consisting of about 0.6% by weight nickel, about 3.1% by weight chromium, about 3.0% by weight molybdenum, about 0.25% by weight vanadium, about 0.3% by weight silicon, about 0.4% by weight manganese, about 0.16% by weight carbon, about 0.035% by weight boron, and the balance iron.

* * * * *